US009457353B2

(12) United States Patent
Dunst

(10) Patent No.: US 9,457,353 B2
(45) Date of Patent: Oct. 4, 2016

(54) COAL PULVERIZER MONITORING SYSTEM AND ASSOCIATED METHODS

(71) Applicant: Orlando Utilities Commission, Orlando, FL (US)

(72) Inventor: Bradley J. Dunst, Christmas, FL (US)

(73) Assignee: Orlando Utilities Commission, Orlando, FL (US)

( * ) Notice: Subject to any disclaimer, the term of this patent is extended or adjusted under 35 U.S.C. 154(b) by 471 days.

(21) Appl. No.: 14/169,443

(22) Filed: Jan. 31, 2014

(65) Prior Publication Data

US 2014/0209719 A1 Jul. 31, 2014

Related U.S. Application Data

(60) Provisional application No. 61/758,934, filed on Jan. 31, 2013.

(51) Int. Cl.
*B02C 25/00* (2006.01)
*B02C 15/00* (2006.01)

(52) U.S. Cl.
CPC ..... *B02C 15/007* (2013.01); *B02C 25/00* (2013.01)

(58) Field of Classification Search
CPC ..... B02C 25/00; B02C 15/007
USPC ..... 241/37, 117–122
See application file for complete search history.

(56) References Cited

U.S. PATENT DOCUMENTS 4,820,980 A 4/1989 Dodson-Edgars
5,244,157 A 9/1993 Brundiek
5,482,218 A 1/1996 Ha
5,522,557 A 6/1996 Tiggesbaumker et al.
5,718,389 A 2/1998 Finken et al.
5,718,390 A 2/1998 Ganser, IV et al.
5,795,445 A 8/1998 Boswell et al.
5,927,623 A 7/1999 Ferguson et al.
6,182,914 B1 2/2001 Carle
6,502,773 B1 1/2003 Hostettler et al.
6,877,682 B2 4/2005 Nieminen et al.
6,981,665 B2 1/2006 Braun et al.
7,182,283 B1 2/2007 Santucci
7,337,995 B2 3/2008 Van Vooren et al.
7,360,726 B2 4/2008 Nilsson et al.
7,591,437 B2 9/2009 Nilsson et al.
7,694,902 B2 4/2010 Demler et al.
7,815,133 B2 10/2010 Belotserkovsky
7,832,665 B2 11/2010 Buonfiglio
7,942,358 B2 5/2011 Posti et al.
8,070,081 B2 12/2011 Wark
8,511,594 B2 * 8/2013 Wark ..... B02C 25/00 241/121
2005/0263630 A1 12/2005 Zhang et al.
2007/0051837 A1 3/2007 Juhlin
2010/0230519 A1 9/2010 Torres et al.
2010/0288862 A1 11/2010 Wark
2010/0327094 A1 12/2010 Stone et al.
2011/0031337 A1 2/2011 Pfeiffer et al.
2011/0101139 A1 5/2011 Inoue et al.

* cited by examiner

*Primary Examiner* — Faye Francis
(74) *Attorney, Agent, or Firm* — Carl Napolitano; GrayRobinson, P.A.

(57) ABSTRACT

A coal pulverizer monitoring system and method measures a displacement of wheels in a vertical roll wheel pulverizer using strain gauges bonded to tension rods in an ambient environment outside the hostile environment of the milling area of the pulverizer. Signals from the strain gauges reflecting strain on the tension rods are converted to a displacement of the wheels inside the pulverizer, and thus a coal bed height.

27 Claims, 8 Drawing Sheets

COAL PULVERIZER MONITORING SYSTEM AND ASSOCIATED METHODS

CROSS REFERENCE TO RELATED APPLICATION

This application claims the benefit of U.S. Provisional Application No. 61/758,934 for Coal Pulverizer Monitoring System and Associated Methods having filing date Jan. 31, 2013, the disclosure of which is hereby incorporated by reference herein in its entirety, and commonly owned.

FIELD OF INVENTION

Embodiments of the present invention are generally directed to pulverizers and monitoring thereof and in particular to monitoring coal height and operation of pulverizer components.

BACKGROUND

As is well known in the power generation industry, coal typically used to generate electricity is dried, pulverized into a fine powder and fed into a boiler to be burned. The resulting combustion is used to generate heat, then steam and electricity.

A pulverizer is typically used to crush and dry the coal. Coal is fed into the center of a rotating table. Three metal rollers, herein referred to as tires, push down on the table and exert many tons of pressure onto the table. As the table rotates, the coal moves outward and under the tires where it is pulverized. During this pulverizing process, hot air is blown through the milling area of the pulverizer to dry and transport resulting coal dust out of the pulverizer. At the top of the pulverizer, a mechanical classification takes place where any uncrushed coal is sent back to the center of the table and crushed again. Any fine grained coal is blown out of the pulverizer.

During the pulverizing process, current (amps) on the table motor is monitored. A differential gas pressure (typically air plus coal dust) across the milling area of the pulverizer is also monitored. These measurements are used to approximate physical characteristics of the pulverizer. However, a method or system for measuring the coal bed height inside the milling area is needed.

It is desirable to accurately measure a level of the coal bed in an online coal pulverizer. One problem associated with such a task is in part because of the harsh environment that exists where the coal is being pulverized. By way of example, it is desirable to measure the height of the coal bed inside the coal pulverizer. However, temperatures inside the pulverizer when it is running typically range between 150-400 degrees Fahrenheit. Further, pulverized abrasive coal is constantly being blown around inside the pulverizer in a turbulent fashion. It is therefore difficult to provide typical measurement instrumentation, especially typical precision instrumentation that can operate for long periods of time in such a hostile environment.

SUMMARY

Embodiments of the invention, as herein described by way of example, measure a displacement of rollers in a vertical roll-wheel coal pulverizer. One or more strain gauges may be bonded to one or more tension rods of a coal pulverizer such that strain gauge signals are provided and conditioned to a voltage signal that reflects strain on the tension rod being measured. Using this signal, the strain may be correlated to displacement of the wheels inside the pulverizer, and thus coal bed height. The milling process in the pulverizer may be turned on and a real-time wheel displacement or coal bed height monitored or recorded.

A method aspect of the invention may comprise monitoring a coal pulverizer by bonding a strain gauge to a surface of a tension rod of the coal pulverizer and operating the coal pulverizer including rotating wheels carried within a milling area for pulverizing coal placed therein, sensing changes in strain signals from the strain gauge, and correlating the strain signals to a displacement of the wheels to determine a coal bed height.

A monitoring system and method according to the teachings of the present invention may be used to meet both operational and maintenance related objectives. By way of example, one embodiment may comprise a monitoring system for indicating when the rollers or wheels are coming close to bottoming out the springs and this may be tied to a control system of the pulverizer as an alarm point. One embodiment may comprise a method for determining if a spring frame is unevenly loaded by comparing the strain in multiple tension rods. Another embodiment may determine how much the wheels and table are wearing over time. Yet another may provide a method for tuning air flow to the pulverizer and also aid in control of a boiler systems.

One embodiment according to the teachings of the present invention may include strain gauges mounted in an orientation for measuring an amount of twisting in real-time for the spring frame, wherein measuring the tension on one side of the rod and the compression on the opposite side of the rod are monitored. Embodiments of the invention taken alone or in combination desirably reduce wear of the pulverizer and therefore desirably reduce maintenance costs. Failures may be detected before they result in a costly correction.

BRIEF DESCRIPTION OF DRAWINGS

Embodiments of the invention are described by way of example with reference to the accompanying drawings in which.

DETAILED DESCRIPTION OF EMBODIMENTS

The present invention will now be described more fully hereinafter with reference to the accompanying drawings, in which embodiments of the invention are shown by way of illustration and example. However, this invention may be embodied in many forms and should not be construed as limited to the embodiments set forth herein. Rather, these embodiments are provided so that this disclosure will be thorough and complete, and will fully convey the scope of the invention to those skilled in the art. Like numerals refer to like elements.

Figure 1:
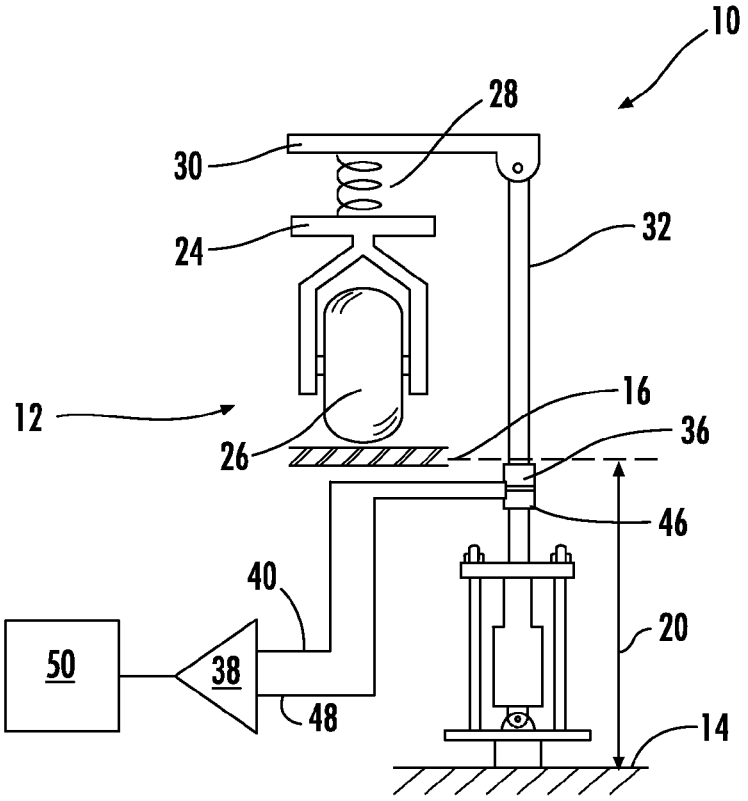
FIG. 1 is a diagrammatical illustration a system for determining coal bed height in a coal pulverizer according to the teachings of the present invention.
Figure 2:
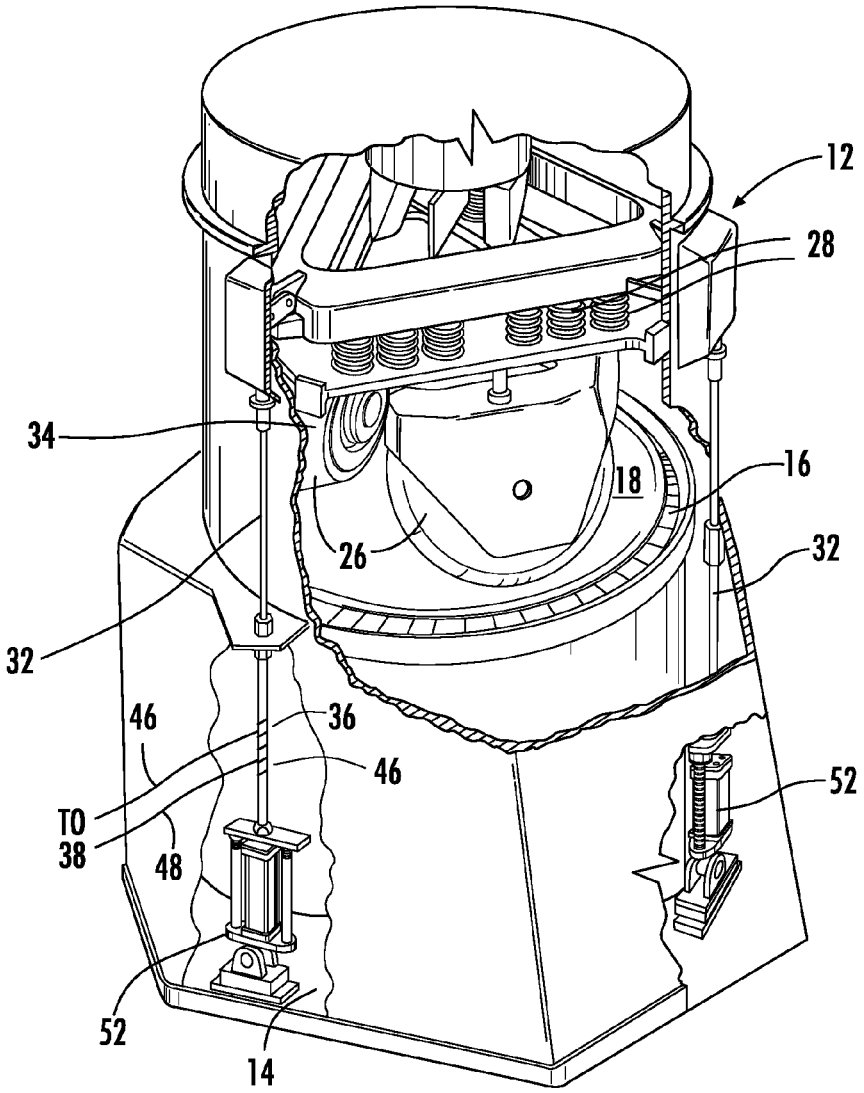
FIG. 2 is a partial cutaway perspective view of a typical coal pulverizer employing a system of the present invention.

One system 10 for monitoring coal being pulverized in a coal pulverizer is herein described by way of example with reference initially to FIGS. 1 and 2 may be described as comprising a coal pulverizer 12, also referred to as a mill, including a base 14 and a table 16 having a surface 18 positioned at a fixed distance 20 from the base. The surface 18 of the table 16 is dimensioned for receiving coal 22 to be crushed, as illustrated with reference to FIG. 3.

For one embodiment, herein described by way of example, the pulverizer 12 comprises a first spring frame 24 and a roller 26, herein multiple rollers also referred to as tires operable for rolling on the surface 18 of the table 16. A spring 28, typically multiple springs, biases the first spring frame 24 against a second spring frame 30, wherein the first spring frame moves closer to the second spring frame through an action of the roller 26 traveling over coal carried on the surface of the table.

Figure 3:
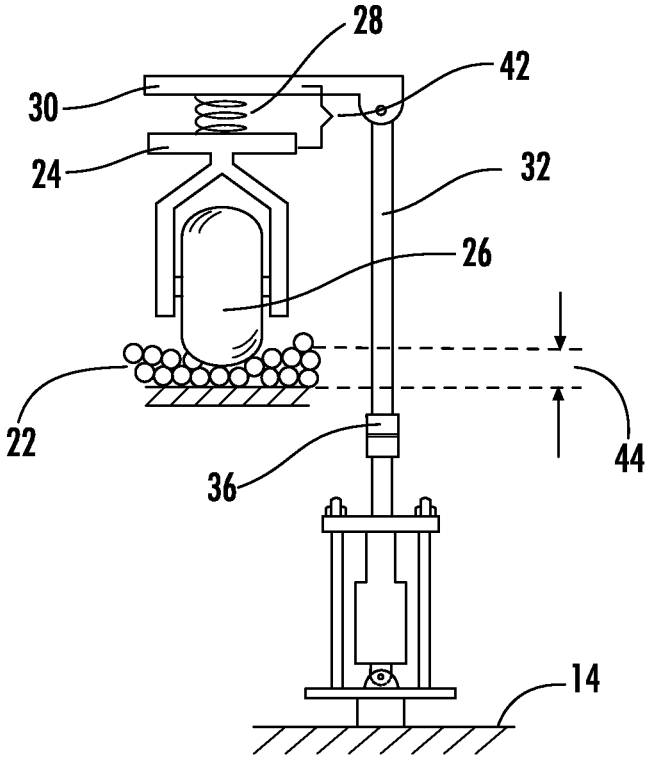
FIG. 3 is a diagrammatical illustration of the embodiment of FIG. 1, wherein a coal height within the pulverizer is illustrated, by way of example.

With continued reference to FIGS. 1-3, tension rod 32 are connected between the second spring frame 30 and the base 14. For the embodiment herein described by way of example, the tension rod 32 is substantially outside a hostile environment 34 of the spring frames 24, 30, springs 28, rollers 26 and the table 16, as illustrated with reference again to FIG. 2.

A strain gauge 36 is bonded directly to the tension rod 32 at a location outside the hostile environment 34, as illustrated with reference again to FIG. 2. With reference again to FIG. 1, a processor 38 is operable for receiving an electrical signal 40 from the strain gauge 36 and provides a measure of displacement 42 of the first spring frame 24 from the second spring frame 30 and thus a height 44 of the coal 22 on the surface 18 of the table 16 in the hostile environment 34 of the coal pulverizer 12.

With continued reference to FIG. 1, a temperature sensor 46 (herein a thermocouple used by way of example) is connected to the tension rod 32 proximate the strain gauge 36 and outside the hostile environment 34 for determining a temperature of the tension rod. A signal 48 from the temperature sensor 46 is processed by the processor 38 for affecting the measure of displacement 42 resulting from temperature. The results may be reported via a display 50 or reporting means as desired.

For the embodiment of the system 10, herein described by way of example, an algorithm operable with the processor provides the displacement based on the strain and the temperature according to a relationship of $$TCD=(BC*\epsilon)-f(TRT)$$

Wherein TCD is the displacement presented as a temperature compensated displacement; BC is a constant associated with a preselected coal pulverizer; $\epsilon$ is the measured mechanical strain; and f(TRT) is a length dimension as a function of the tension rod temperature for the preselected coal pulverizer.

As will be described later in this disclosure, the processor 38 may be programmed to provide the displacement based on wear of structural elements of the coal pulverizer over time and the effect on displacement. As illustrated with reference again to FIG. 2, multiple tension rods 32, the strain gauge 36 may comprise a plurality of strain gauges operable with each tension rod and the processor 38.

As is well known in the art, tension rods 32 of a coal pulverizer 12 are constantly under tension and pull down on the upper, second spring frame 30 which then in turn compresses the springs 28 and ultimately pushes on the pulverizer table surface 18 using the rollers 26. As illustrated with reference again to FIG. 2, the tension rods 32 are typically connected to a concrete foundation as the base 14 through a locked hydraulic loading cylinder assembly. The tension rod 32 itself is located on the outside of the coal pulverizing hostile environment 34. As above described, the spring frames 24, 30, springs 28, tires 26 and table 16 are all located inside the harsh/hostile environment 34 of the pulverizer 12. As a result, the tension rods 32 are in a desirable location for instrumentation and would not be exposed to the high temperatures or abrasive pulverized coal.

There is a relationship between the strain in the tension rod 32 and the deflection of the pulverizer rollers/tires 26. As the tension rod 32 stretches, the strain gauge 36 produces an output, the signal 40, proportional to the strain in the tension rod. In the milling area of the pulverizer, if the rollers, typically solid metal tires, start to move upward, as a result of the coal bed height 44 increasing, the rollers 26 and lower/first spring frame 24 move upward and push against the springs 28 which themselves push against the upper/second spring frame 30, as illustrated with reference again to FIG. 3. With the upper/second spring frame 30 fixed in place by the tension rods 32 (generally at least three), the tires 26 move upward, the springs 28 compress and the strain in the rods 32 increases.

For a typical pulverizer 12, there are multiple tension rods 32. As above illustrated, a strain gauge 36 may be placed on one or a plurality of the rods 32 as desired without departing from the teachings of the present invention. Further, there are typically multiple springs 28, as illustrated with reference again to FIG. 2.

Figure 4:
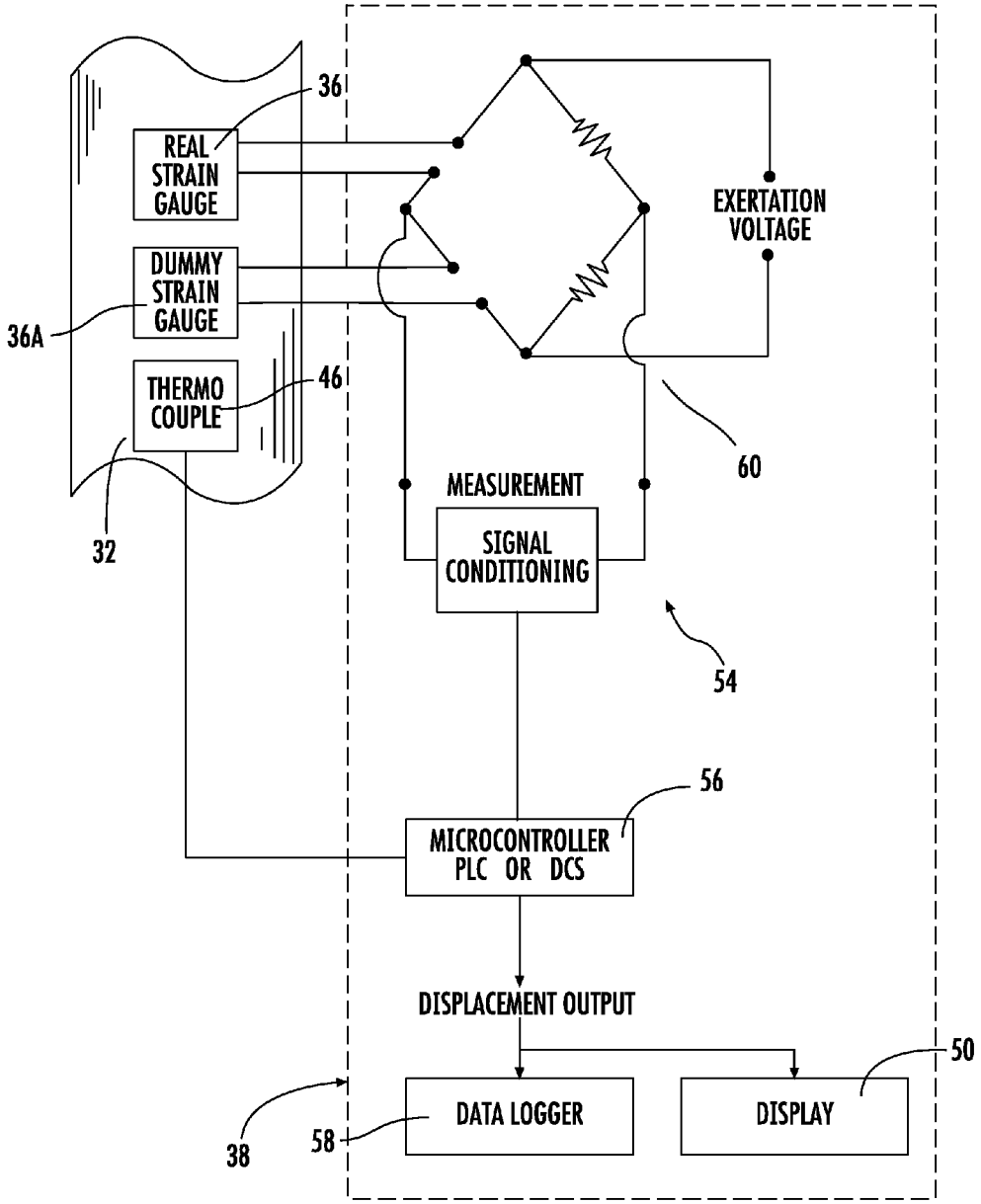
FIG. 4 is a diagrammatical illustration of signal collection and processing processor according to the teachings of the present invention.

As illustrated with reference to FIG. 4, one prototype embodiment of the system 10 included instrumenting one tension rod 32 with a standard multipurpose strain gauge 36. A strain gauge amplifier 54 including signal processing and a microcontroller 56 forms the processor 38. Further, a data logger 58 was employed. The system 10 was setup when the pulverizer 12 was out of service and void of the coal 22. The strain gauge 36 bonded to the tension rod 32 is connected to the strain gauge amplifier 54. A second strain gauge 36A is bonded next to the first strain gauge 36 in an opposite axis orientation and also connected to the amplifier 54 for providing wire length and temperature compensation. The signals from the gauges 36, 36A are fed to an on-board wheat-stone bridge 60 of the amplifier 54. The purpose of the second strain gauge 36A and wheat-stone bridge 60 is to cancel effects from temperature at the strain gauge 36 and wire length compensation. The wire and strain gauges were shielded from EMF effects. The signal from the amplifier 54 included a millivolt signal and was sent to the processing unit 54 for calculation into a displacement and then sent to the data logger 58. As the tension rod 32 stretched, the data logger 58 would see a change in displacement. By way of non-limiting example, the millivolt signal could bypass the processing unit and go directly to the data logger for raw signal logging.

Figure 5:
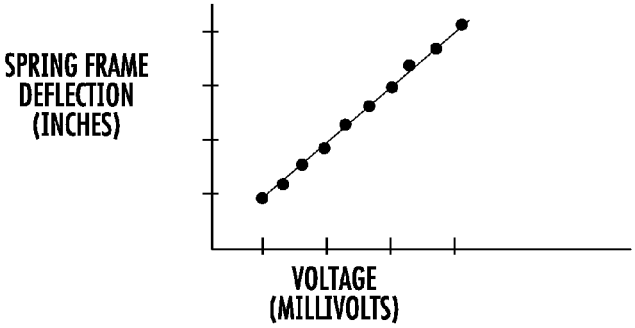
FIG. 5 is plot of spring frame deflection versus voltage indicative of tension rod deformation measured by strain gauges placed on a tension rod operable with the pulverizer of FIG. 1.

Performance parameters and measurement relationships were developed based on empirical data for one typical particular pulverizer. By way of example, a voltage response to actual deflections of the pulverizer tires was determined. The resulting relationship is presented as a curve and estimated to be linear based on the fact that the pulverizer has linear styled springs and behaves according to a traditional spring equation F=kx, where F is a force, x is a displacement, and k is the spring constant. To verify the linear relationship, and by way of non-limiting example, voltage was recorded when the mill had 2000 lbs. of force on each tension rod and when the tires were directly on the table. Measurements were made and recorded at the spacing 42 between the upper and lower spring frame. The force in each rod was doubled, and measurement steps repeated. For the example herein presented by way of example, measurements were made at ten various conditions and then plotted on a graph to verify that the relationship was linear, as illustrated with reference to FIG. 5.

This curve was also used to develop a plot for voltage vs. bed height for the pulverizer. Once this plot is developed, an equation is determined in order to provide the coal bed height 44 for a given voltage. As further described, temperature compensation resulting from structural changes are provided for determining a temperature compensated coal bed height measurement.

By way of example, the strain and temperature are used to calculate coal bed height inside the pulverizer according to the following relationship of Equation 1:

$$TCD=(BC*\epsilon)-f(TRT)-f(\text{time and coal hardness})$$

Wherein TCD=Temperature Compensated Displacement resulting from thermal growth of structural elements; BC=Constant; $\epsilon$=Measured Mechanical Strain; and TRT=Tension Rod Temperature.

The variable TCD is the real temperature compensated displacement of the springs inside the pulverizer. This means that if coal is forced underneath the wheels during operation, the spring frame will be pushed up in-turn displace the springs. Thus, TCD is the same value as coal bed height.

Phase one of research and development included using part of Equation one to calculate coal bed height. Phase two includes the use of the third term in Equation one, "f(time and hardness)" to compensate for pulverizer wheel wear over extended lengths of time and Phase three includes using more than one tension rod per mill to alarm previously mentioned anomalies.

During testing, the system included one strain gauge placed on one of the three tension rods of the mill. It was understood that under normal operation of the mill, all three tension rods will have approximately the same strain placed on them. The only time this would not be the case is if a mechanical member failed and/or some foreign object was feed into the mill and/or the springs were not tensioned evenly during setup. These are special cases and depart from the coal bed height measurement (Phase one), but will be of interest for the Third phase of development. The Third phase will be detailed later, and will include using the above system and processing for all three tension rods in order to provide an alarm when a mechanical failure occurs, resulting from foreign debris or unbalanced spring frame loading based on a deviation in their measurement, by way of example.

As above illustrated, the computation of TCD which is equal too coal bed height requires three components:

Component 1: (BC*$\epsilon$)=non-temp compensated spring displacement Component 2: f(TRT)=perceived spring displacement due to only temp.

Component 3: f (time and coal hardness)=perceived displacement from wear.

Thus, if you compute component 1 and subtract component 2 and component 3 therefrom, the result will be an actual measurement of coal bed height.

Component 1 represents the non-temp compensated spring displacement. This can also be referred to as x. It is understood that component 2 is distinguished from the temperature compensation provided by the bridge circuit described above.

As described above, in order to calculate x, the constant BC has to be multiplied by the strain output from the amplifier/filter.

$$x=(BC*\epsilon)=\text{component 1=units of length}$$

The constant BC is specific to a single pulverizer. It can be calculated analytically or derived through empirical testing. In order to accurately calculate analytically, one would have to know the exact geometry and material properties of every component in the mill that transfers load of the springs. One would also need lab tested spring constants of every spring in the pulverizer. Due to this complexity, empirical testing was chosen as a practical means to find BC. The units of BC are of length.

In order to find BC empirically, the equation of component 1 is rearranged as:

$$BC=x/\epsilon$$

In order to find the term x and $\epsilon$, several steps take place. The mill is cleaned and ready for service. The strain gauge output is calibrated to zero. The spring displacement at this zero strain is measured. Once these steps are completed, a measureable amount of tension is placed on the rods using standard maintenance equipment. The new output from the stain amplifier/filter will represent $\epsilon$ in the equation above. The difference from the old spring displacement and the new spring displacement will represent x in the equation above. With these two terms BC can be computed.

By way of example for the springs herein represented, only one data point is necessary to calculate BC because the springs in the pulverizer are linear springs. The linearity was not just an assumption but was proven during hands-on testing by calculating BC over five separate data points. Every new data point was measured at a higher tension. The results were plotted and proved the linearity.

Once you have BC for a mill, it can then be used to calculate component 1 in equation 1 using the strain output from the amplifier/filter also known as $\epsilon$.

Component 2 is the perceived spring displacement due to temperature. The need for component 2 was discovered during testing because of measurement drift that was occurring with the pulverizer when out of service due to ambient temperature changes. This drift was due to temperature changes in the mechanical load components because of the ambient temperature changes. It was proven through testing that the tension rod was an optimum location in the load transmission path of the mill to compute the displacement due to temperature.

$$\text{Component 2}=f(TRT)=\text{units of length}$$

Just as for BC, component 2 can be derived analytically or through empirical testing. If it is to be derived analytically, one would need to be able to predict all the heat fluxes for all the mechanical components in the load transmission path. One would also need the exact geometry and material properties of those same components. In practice, the analytical derivation would be possible, but impractical.

Component 2 will return the perceived spring displacement due to temperature only. In order to derive f(TRT) empirically, the mill is cleaned and ready for service. The temperature of the tension rod is measured continuously throughout the test. Once ready, the mill is heated up, just as though it was in service but without feeding coal to the mill and without turning on the pulverizer. The data are plotted and a curve fit to the data represents perceived spring displacement as a function of TRT. Alternatively, a matrix could be used in place of the curve fit in order to generate component 2.

Once the f(TRT) is generated, temperature of the tension rod is used to compute the perceived spring displacement and subtracted from component one in order to calculate the TCD. This is without accounting for pulverizer mechanical component wear compensation, herein referred to as component 3.

Component 3 is perceived spring displacement from wear. This component is a function of mill runtime and coal hardness.

Component 3=*f*(time and coal hardness)=units of length

It will approximate the change in measured spring displacement due to pulverizer tire, spring, table and other mechanical component wear. Generally, this component should not be necessary if BC and f(TRT) are calibrated annually because the wear is typically significant over relatively long periods of time. Thus, component 3 improves the accuracy over long periods of time for operation of the mill, but is an optional parameter and while useful is not absolutely necessary. Once the component 3 is derived, time and coal hardness can be used to calculate the perceived spring displacement from wear and will be subtracted from component 1 minus component 2.

Testing for supporting the above approach was conducted while not including component 3, tire wear. Measurements were made with the pulverizer fed with coal and with coal removed. The pulverizer was loaded and unloaded. Measurements were seen to track upwardly on the data logger and back down during "sweeping" of the pulverizer, wherein as the milling area was sweeping. As will be understood by those of skill in the art, as the milling area cooled, the measurement changed. After the pulverizer had cooled, the resulting calculations indicated that there was ¾" of a coal bed still in the milling area. After opening the pulverizer, the coal bed was measured and there was exactly ¾" of coal under the tire.

Figure 6:
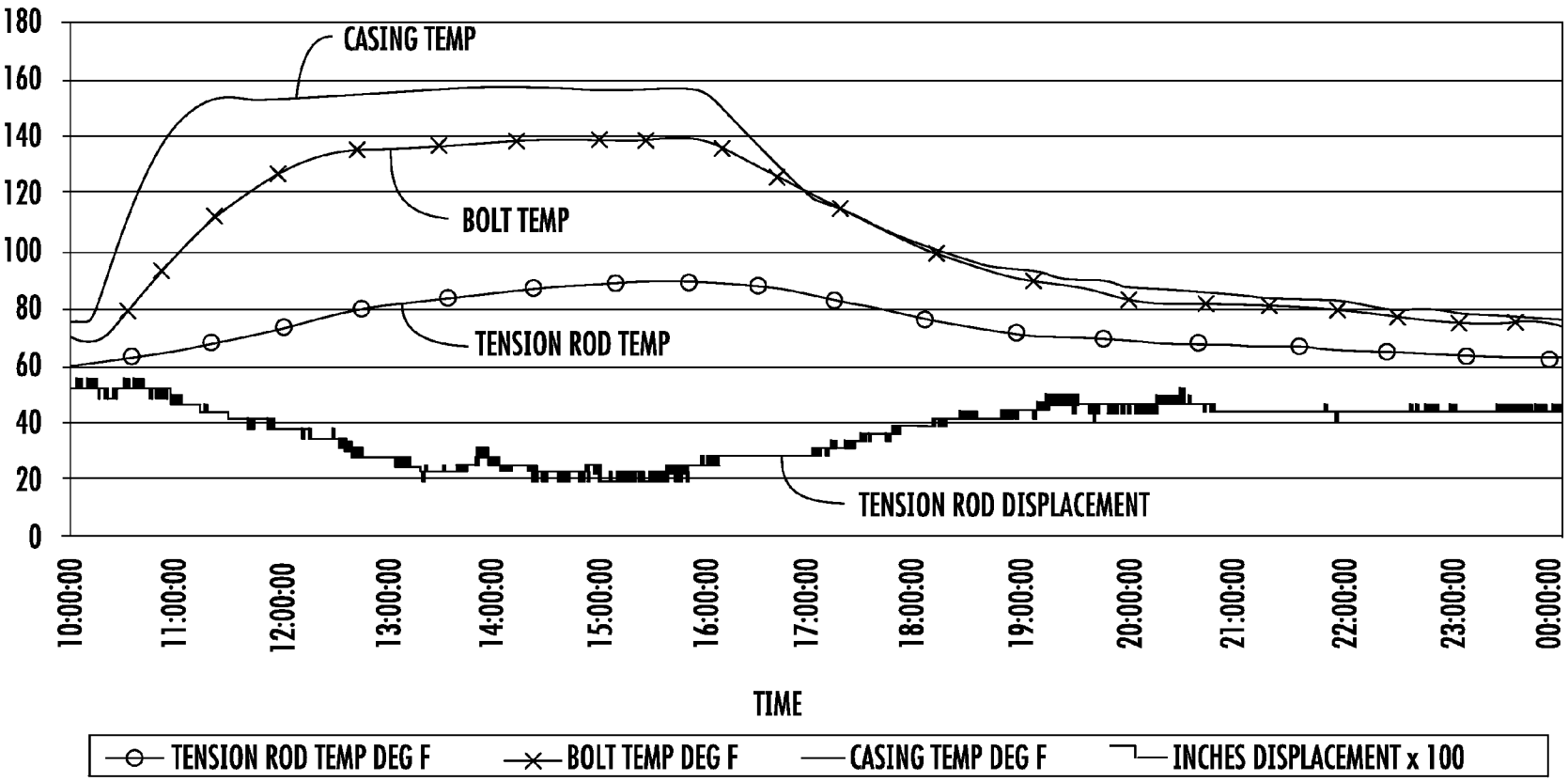
FIG. 6 is a combination plot including tension rod temperature, bolt temperature, casing temperature and tension displacement versus time.

Adverse temperature effects to the measurement and monitoring embodiments are eliminated. With instrumentation configured to cancel out temperature effects to the strain gauge setup, temperature effects resulting from thermal expansion are addressed and components affecting measurement identified by placing thermocouples throughout the pulverizer. By way example, thermocouples were placed on the tension rod, the case of the pulverizer, the top of the spring frame, the bolt on the yoke assembly and a thermocouple was arranged to measure ambient temperatures. During the test and evaluation process, the spring frame displacement strain gauge was maintained in place to compare thermocouple temperatures to perceived deflection. The pulverizer was heated up without containing coal. Temperature measurements including deflections over time were logged based on measured deflections. Examination of resulting data revealed that the tension rod itself included the only temperature that tracked with the perceived deflection, as illustrated with reference to FIG. 6, by way of example, including tension rod temperature, bolt temperature, casing temperature and tension displacement versus time, by way of example.

Figure 7:
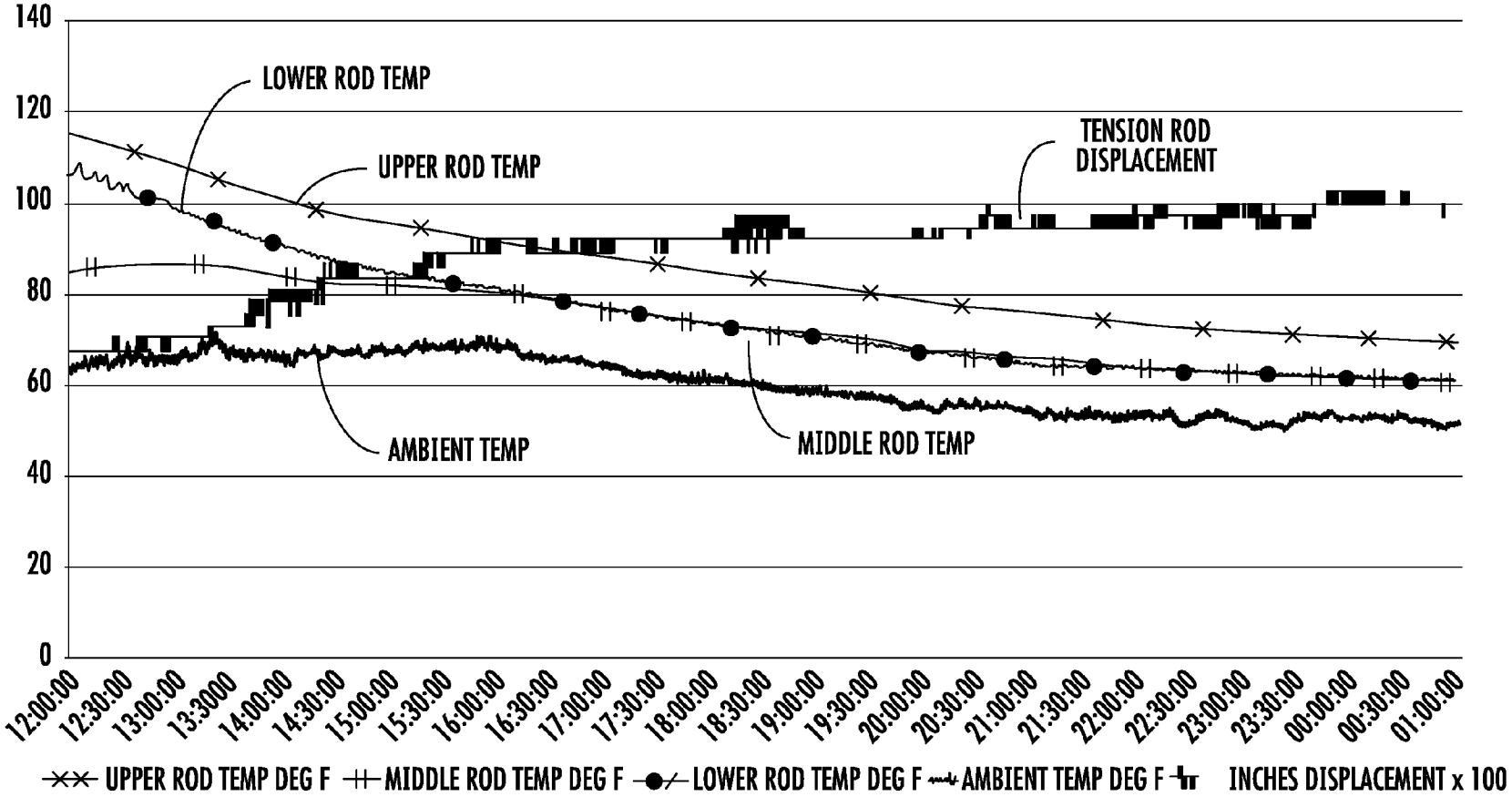
FIG. 7 is a combination plot of upper rod temperature, middle rod temperature, lower rod temperature, ambient temperature, and rod displacement versus time.

A follow-up thermal test was performed where thermocouples were placed at various locations on the tension rod to determine if one particular location on the tension rod represented the perceived deflection more than another. A goal was to develop an algorithm that canceled thermal expansion from the displacement measurement using a thermocouple and specific location. Measurements of ambient temperature were also performed. The pulverizer was again heated up without turning on its table motor and without feeding coal into the milling area. It was observed that all locations on the tension rod having thermocouples were almost identical in representing a perceived displacement variation. The tracking was provided in an inverted and scaled manner, as illustrated with reference to FIG. 7 including upper rod temperature, middle rod temperature, lower rod temperature, ambient temperature, and rod displacement versus time, by way of example.

A formulation developed to invert and bias the displacement measurement to compare displacement as a function of temperature of the tension rod at the strain gauge was developed. A test was performed for verification purposes and to confirm that all development thus far was consistent.

Figure 8:
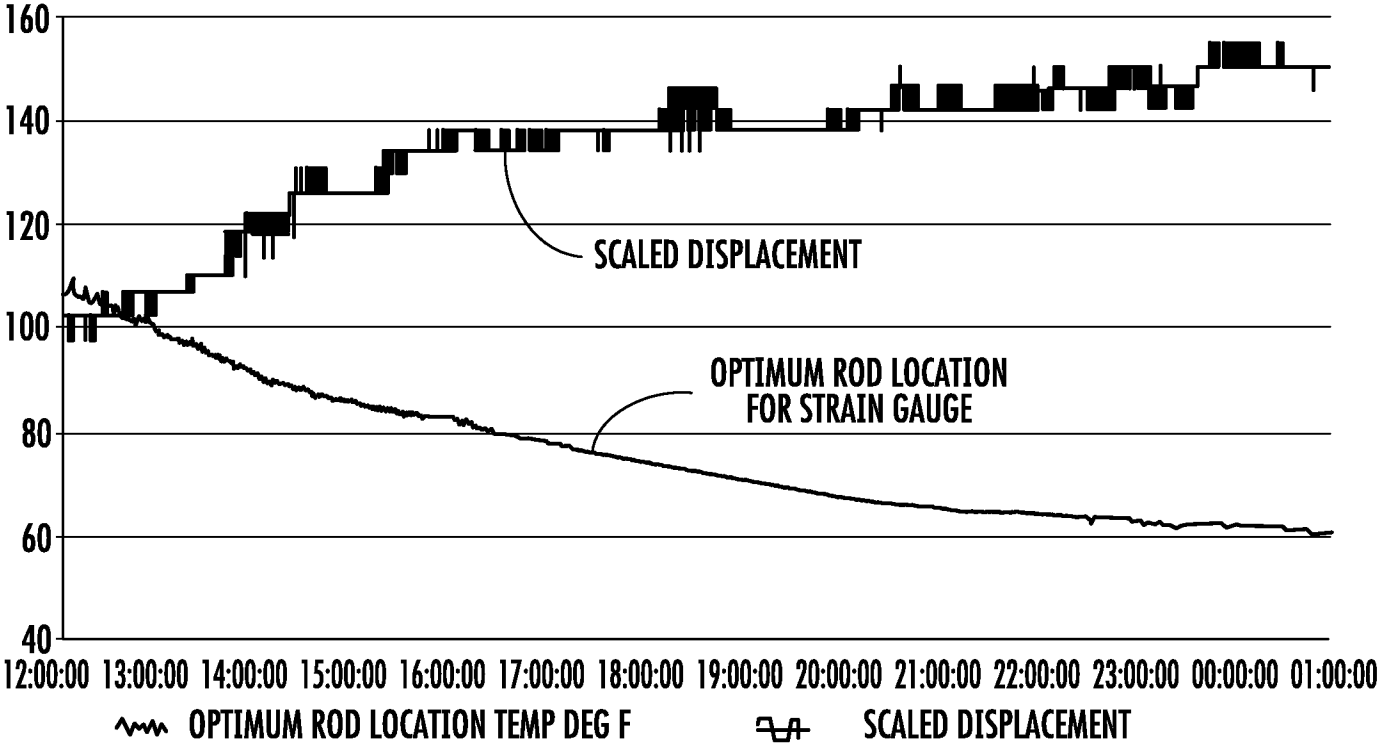
FIG. 8 is a combination plot of an optimum rod measurement location and scaled rod displacement versus time.

Analysis of resulting data resulted in an ability to compare the displacement and inverted/scaled performance to temperatures at different locations to determine which temperature most accurately represented the thermal expansion of the system. As a result, plots of an optimum rod measurement location and scaled rod displacement versus time were possible, as illustrated with reference to FIG. 8.

Based on these results, the algorithm, as above described, was developed for calculating the actual bed height displacement after being corrected for thermal expansion. This equation uses the spring frame deflection calculated and described above using the stain gauge with the BC constant and the temperature at the tension rod to accurately calculate bed height regardless of mill temperature.

Figure 9:
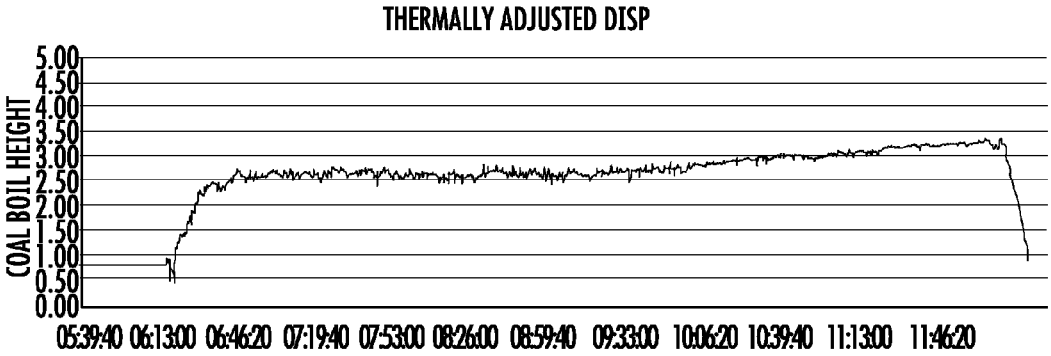
FIG. 9 is a plot of coal bed height versus time during operation of a coal pulverizer.

During testing, the spring frame displacement was calculated using the strain gauge located on the tension rod and the techniques discussed above. Temperatures at the tension rod were also measured. The pulverizer was placed in service as normal and taken out of service. As illustrated with reference to FIG. 9, results were found to be as desired. Once the pulverizer was taken out of service, it was noted that the bed height indicated 0.9". The doors on the pulverizer were opened and it was confirmed that there was almost an inch of coal under the tire. The system and method according to the teachings of the present invention proved to be fruitful and actuate. The logger and instrumentation were operable with the pulverizer for several weeks for monitoring, and resulted in consistent performance by the measurement and monitoring system herein described by way of example.

It is of interest to note that several weeks into the testing, resulting data showed a spike in the bed height every few seconds. The pulverizer was taken out of service and emptied. A large piece of steel (approximately 13"×7"×1") was found inside the pulverizer. The tires must have kept running over the piece of steel and it is not clear that this precursor to damage would have been found if it were not for the bed height instrumentation. As seen, the embodiment herein presented for measuring bed height, can also be used to provide an indication of a problem such foreign material in the pulverizer like the a piece of steel.

During the physical installation and setup of the coal bed height system device, it is practical to have the pulverizer emptied, opened and the tension removed from the rods. By way of example, one installation method may begin by bonding the thermocouples to the tension rod at desired locations.

By way of further example, the monitoring system is ready to develop constants for the above described equations. The tension will first need to be removed from the tension rods. Then the tire height above the table will need to be measured if not at a zero position, and if not at zero would be added to spring frame deflection. The gap between the upper and lower spring frame is to be measured. This will be the first data point on the linear curve for strain gauge voltage vs. displacement above discussed with reference to FIG. 5. By way of example, it is desirable to place half of the normal preload on the tension rods because of the linear relationship. The displacement and voltage are then noted and become the second point on the curve of FIG. 5. This will all be repeated at the normal running tension rod preload to get a third point on the curve. The pulverizer BC constant can then be calculated from the curve for the pulverizer of interest. Only two data points are required because of the verification of linearity performed in the previous section.

The data last to be calculated are used for the f(TRT) equation. To construct the equation above described, the pulverizer will need to be heated up and cooled down without turning on the motor or feeding coal into the pulverizer. The perceived bed height is logged along with the tension rod temperature. Using these data, the f(TRT) can then be calculated.

Although the invention has been described relative to various selected embodiments herein presented by way of example, there are numerous variations and modifications that will be readily apparent to those skilled in the art in light of the above teachings. It is therefore to be understood that, within the scope of the claims supported by this specification, the invention may be practiced other than as specifically described.

That which is claimed is:

1. A system for monitoring coal being pulverized in a coal pulverizer, the system comprising:

a coal pulverizer including:

a base:

a surface positioned at a fixed distance from the base for receiving coal to be crushed thereon;

a frame;

a roller flexibly biased to the frame for rolling on coal placed thereon; and a tension rod securing the frame to the base;

a strain gauge affixed directly to the tension rod at a location outside a hostile environment of the roller; and a processor operable for receiving an electrical signal from the strain gauge and providing a measure of displacement of the roller from the surface, thus a height of coal on the surface of the table in the hostile environment.

2. The system according to claim 1, wherein the coal pulverizer further comprises a spring biasing the roller toward the surface, wherein the roller is in a variable spaced position to the frame through an action of the roller traveling over coal carried on the surface.

3. The system according to claim 2, further comprising a temperature sensor operable with the tension rod outside the hostile environment for determining a temperature thereof, wherein a signal from the temperature sensor is processed by the processor for affecting the measure of displacement resulting from the temperature.

4. The system according to claim 3, wherein the processor provides the displacement based on the strain and the temperature according to a relationship of $$TCD=(BC*\epsilon)-f(TRT)$$

wherein TCD is the displacement presented as a temperature compensated displacement;

BC is a constant associated with a preselected coal pulverizer;

$\epsilon$ is the measured mechanical strain; and f(TRT) is a length dimension as a function of the tension rod temperature for the preselected coal pulverizer.

5. The system according to claim 4, wherein the processor further provides the displacement based on perceived deflection due to wear of structural elements of the coal pulverizer over time and the effect on spring displacement.

6. The system according to claim 1, wherein the processor comprises a strain gauge amplifier having a Wheatstone bridge in electrical contact to the stain gauge, a power supply providing an electrical signal to the Wheatstone bridge and a signal conditioner for converting the electrical signal from the strain gauge to a digital signal operable with a controller, and wherein the Wheatstone bridge includes a dummy strain gauge for cancelling temperature effects at the gauge.

7. The system according to claim 1, wherein the tension rod comprises multiple tension rods, and wherein the strain gauge comprises at least one strain gauge on at least two of the plurality of tension rods.

8. A system for monitoring coal being pulverized in a coal pulverizer, the system comprising:

a coal pulverizer including:

a base;

a table positioned at a fixed distance from the base, the table having a surface dimensioned for receiving coal to be crushed thereon;

a first spring frame;

a roller rotatable with the first spring frame and operable for rolling on the surface of the table;

a second spring frame:

a spring biasing the first spring frame against the second spring frame, wherein the first spring frame moves closer to the second spring frame through an action of the roller traveling over coal carried on the surface of the table; and a tension rod operable with the second spring frame, wherein the tension rod is fixed to the base, and wherein at least a portion of the tension rod is outside a hostile environment of the spring frames, spring, roller and table;

a strain gauge affixed directly to the tension rod at the portion thereof;

a processor operable for receiving an electrical signal from the strain gauge and providing a measure of displacement of the first spring frame from the second spring frames and thus a height of coal on the surface of the table in the hostile environment of the coal pulverizer, wherein the processor employs a spring constant of the spring and strain measured by the strain gauge to determine the displacement.

9. The system according to claim 8, further comprising a temperature sensor operable with the tension rod outside the hostile environment for determining a temperature thereof, wherein a signal from the temperature sensor is processed by the processor for affecting the measure of displacement resulting from the temperature.

10. The system according to claim 9, wherein the processor provides the displacement based on the strain and the temperature according to a relationship of $$TCD=(BC*\epsilon)-f(TRT)$$

wherein TCD is the displacement presented as a temperature compensated displacement;

BC is a constant associated with a preselected coal pulverizer;

$\epsilon$ is the measured mechanical strain; and f(TRT) is a length dimension as a function of the tension rod temperature for the preselected coal pulverizer.

11. The system according to claim 10, wherein the processor further provides the displacement based on wear of structural elements of the coal pulverizer over time and the effect on spring displacement.

12. The system according to claim 8, wherein the processor comprises a strain gauge amplifier having a Wheatstone bridge in electrical contact to the stain gauge, a power supply providing an electrical signal to the Wheatstone bridge and a signal conditioner for converting the electrical signal from the strain gauge to a compatible signal operable with a controller, and wherein the Wheatstone bridge includes a dummy strain gauge for cancelling temperature effects at the gauge and from wire length employed.

13. The system according to claim 12, further comprising a controller operable for receiving the compatible signal from the strain gauge amplifier and the temperature sensor, and wherein the displacement is provided thereby.

14. The system according to claim 8, wherein the temperature sensor comprises a thermocouple.

15. The system according to claim 14, wherein the thermocouple is attached to the tension rod portion proximate the strain gauge.

16. The system according to claim 8, wherein the tension rod comprises multiple tension rods, and wherein the strain gauge comprises a plurality of strain gauges operable with the processor.

17. A method for monitoring a coal pulverizer utilizing a coal pulverizer having a surface positioned at a fixed distance from a base for receiving coal to be crushed thereon, a roller flexibly biased to a frame for rolling on the surface and coal therebetween, and a tension rod securing the frame to the base, the method comprising:

bonding a strain gauge to a portion of the tension rod, wherein the portion is located outside a hostile environment of the roller;

operating the coal pulverizer for pulverizing coal placed on the surface thereof;

sensing changes in strain signals from the strain gauge;

correlating the strain signals to a displacement of the roller; and determining a coal bed height therefrom.

18. The method according to claim 17, wherein the correlating comprises:

receiving an electrical signal from the strain gauge;

providing a measure of displacement of the frame;

determining a spring constant of a spring operable between the roller and the frame, wherein the spring constant is a measure of a flexible biasing of the flexibly biased roller; and determining the coal bed height from a combination thereof.

19. The method according to claim 17, further comprising:

measuring a temperature of the tension rod;

determining an effect of the temperature on the displacement measurement; and modifying the coal bed height resulting from the effect.

20. The method according to claim 19, wherein the temperature measuring comprises placing a thermocouple on the tension rod for providing a measure of the temperature.

21. The method according to claim 20, wherein the thermocouple placing comprises placing the thermocouple on the tension rod proximate the strain gauge.

22. The method according to claim 19, wherein the displacement measurement is based on the strain and the temperature according to a relationship of $$TCD=(BC*\epsilon)-f(TRT)$$

wherein TCD is the displacement presented as a temperature compensated displacement;

BC is a constant associated with a preselected coal pulverizer;

$\epsilon$ is the measured mechanical strain; and f(TRT) is a length dimension as a function of the tension rod temperature for the preselected coal pulverizer.

23. The method according to claim 22, further comprising determining an effect of wear of structural elements of the coal pulverizer over time and the effect on spring displacement, and modifying the presented displacement based on the effect of wear.

24. The method according to claim 17, wherein the strain gauge bonding comprises bonding a plurality of strain gauges on a plurality of tensions rods operable with the coal pulverizer, and wherein a plurality of strain signals is provided by the strain gauges for correlating the plurality of strain signals for determining the displacement of the roller and thus the coal bed height determining.

25. The method according to claim 24, further comprising bonding first and second strain gauges on opposing sides of each of the plurality of tension rods and comparing the strain measures in each for determining if the frame is unevenly loaded.

26. The method according to claim 24, further comprising bonding first and second strain gauges on opposing sides of each of the plurality of tension rods and measuring an amount of twisting of the spring frame by determining a strain on one side of each tension rod and compression on the opposing side.

27. The method according to claim 17, wherein the sensing comprises providing a strain gauge amplifier having a Wheatstone bridge in electrical contact with the strain gauge, providing a power supply for delivering an electrical signal to the Wheatstone bridge, and using a signal conditioner for converting the electrical signal from the strain gauge.

* * * * *